United States Patent [19]

Bouplon

[11] Patent Number: 4,616,716

[45] Date of Patent: Oct. 14, 1986

[54] SYNCHRONOUS VIBRATORY IMPACT HAMMER

[75] Inventor: Edward J. Bouplon, Solon, Ohio

[73] Assignee: Allied Steel & Tractor Products, Inc., Solon, Ohio

[21] Appl. No.: 593,678

[22] Filed: Mar. 26, 1984

Related U.S. Application Data

[63] Continuation-in-part of Ser. No. 353,628, Mar. 1, 1982, abandoned.

[51] Int. Cl.[4] ..... B25D 11/06

[52] U.S. Cl. ..... 173/49; 74/61

[58] Field of Search ..... 173/49, 162 R, 149, 173/113, 22; 175/55, 56; 74/61

[56] References Cited

U.S. PATENT DOCUMENTS

| | | | |
|---|---|---|---|
| 3,866,693 | 2/1975 | Century | 173/49 |
| 3,909,149 | 9/1975 | Century | 173/49 |
| 4,143,719 | 3/1979 | Furukawa et al. | 173/49 |

*Primary Examiner*—Donald R. Schran
*Assistant Examiner*—James L. Wolfe
*Attorney, Agent, or Firm*—Charles L. Johnson, Jr.

[57] ABSTRACT

A vibratory impact hammer including a hammer body assemblage suspended by rubber mounts for reciprocal axial movement in a support frame, the rubber mounts providing guiding and damping action of the assemblage in either director of axial movement without extraneous friction forces acting thereupon, and a pair of synchronously driven eccentric weights which are arranged to provide vibratory movement of the assemblage.

8 Claims, 8 Drawing Figures

SYNCHRONOUS VIBRATORY IMPACT HAMMER

This application is a continuation-in-part of my application Ser. No. 353,628, filed Mar. 1, 1982, now abandoned.

BACKGROUND OF THE INVENTION

This invention relates to a synchronous vibratory hammer employing a driving and a driven eccentric weight arranged to produce vibratory action which may be used for impacting a tool upon a work surface.

The art of vibratory hammers, of the type with which this invention is concerned, is well developed and many different designs have been proposed and employed with varying degrees of success. U.S. Pat. No. 3,866,693, dated Feb. 8, 1975 to Bernard A. Century, is representative of one such vibratory hammer.

The subject invention has certain elements in common with the device of the Century patent, however, it differs in at least one important respect, namely, it has no mechanical restraints which can absorb energy, such as would be caused by the guides 186 and 188 of Century's patent. The mechanical restraints in the Century patent are used to control non-linear motion of the hammer element being driven by a single eccentric. The device of the subject invention eliminates the need for such mechanical restraints because of the fact that two eccentrics are used.

The device of the subject invention requires less maintenance than vibratory hammers having non-linear impacting vibrations, which not only shake the hammer supporting mechanism, but are subject to greater wear and breakage.

A primary object of the invention is to provide a vibratory hammer with improved operating efficiency, and which minimizes maintenance costs.

These and further objects and features of the invention will become more apparent from an understanding of the following disclosure.

REFERRING NOW THE DRAWINGS

Figure 1:
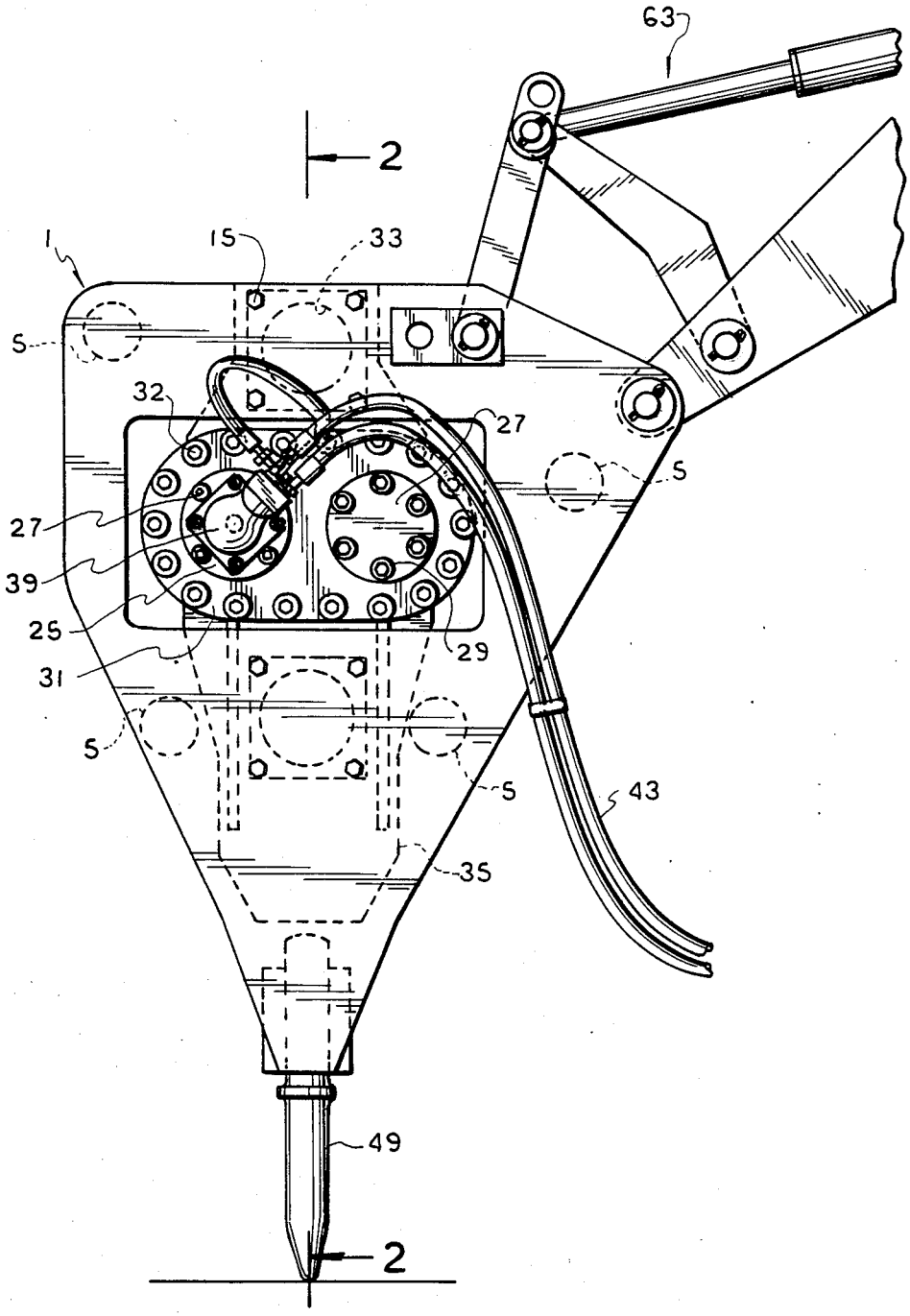
FIG. 1 is a side elevation view of a vibratory hammer embodying the principles of the invention.
Figure 2:
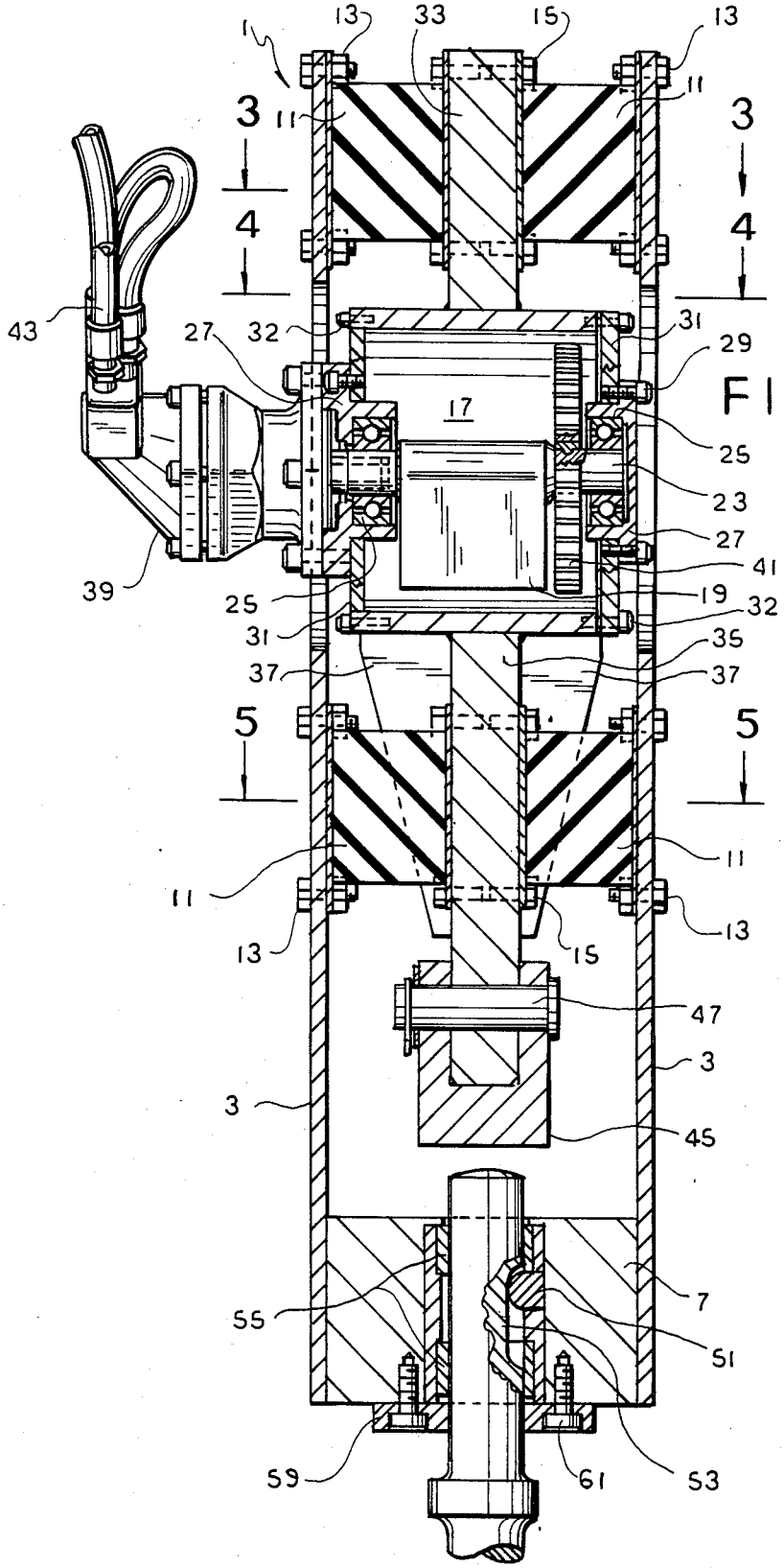
FIG. 2 is an enlarged section view as seen from line 2—2 in FIG. 1.
Figure 3:
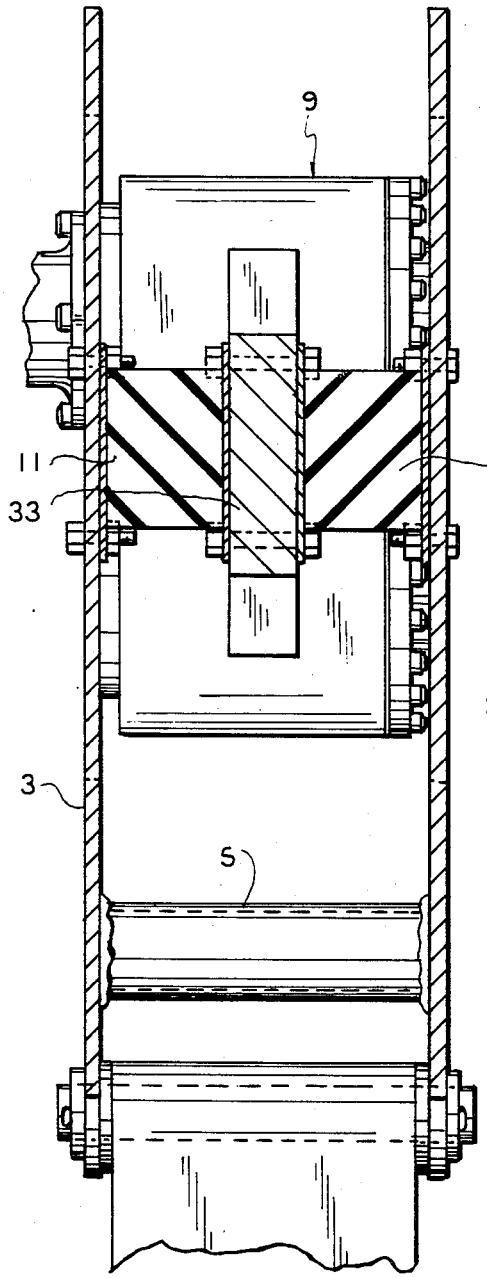
Figure 4:
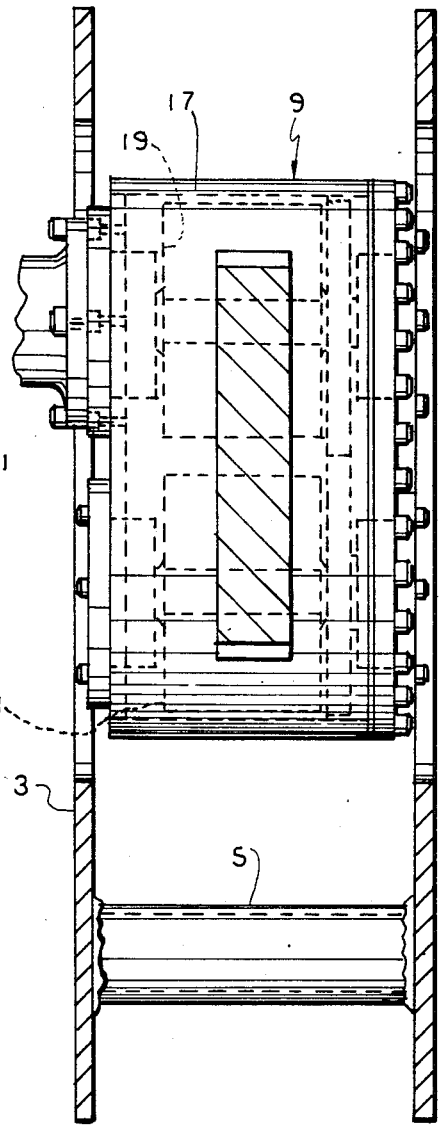
Figure 7:
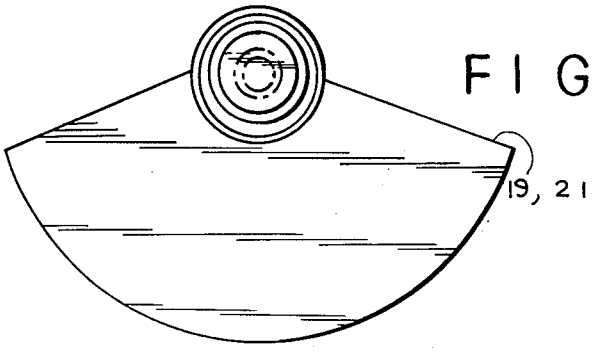
Figure 5:
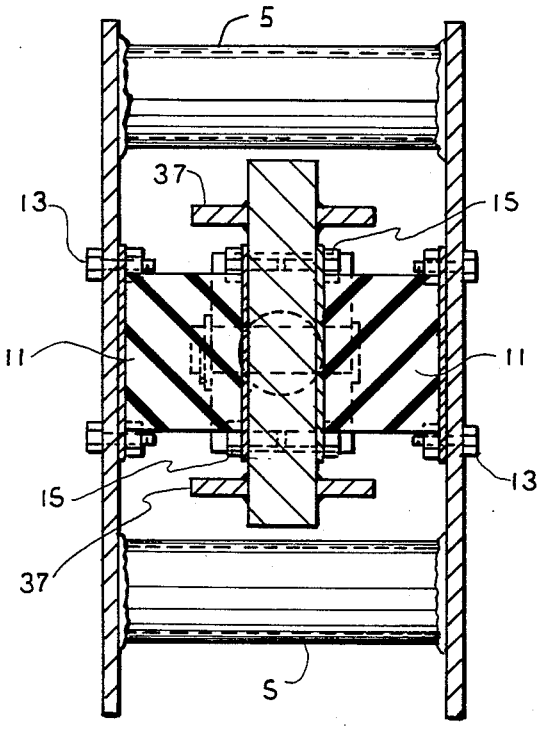
Figure 6:
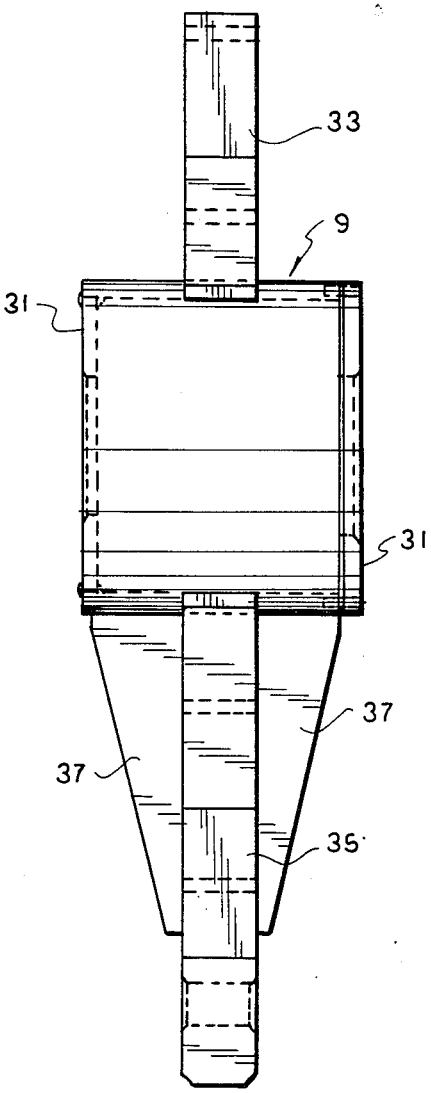
Figure 8:
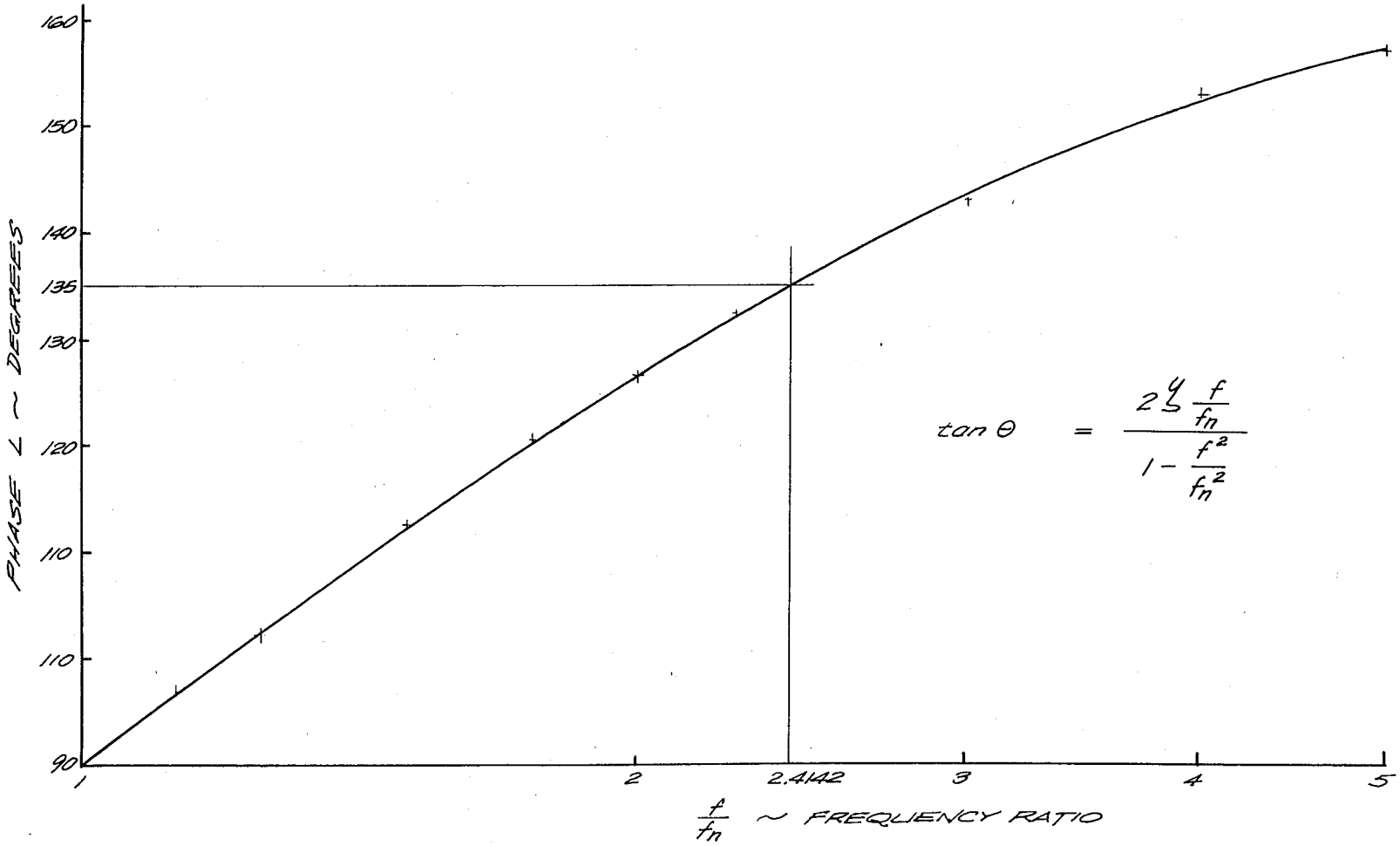

FIGS. 3,4 and 5 are cross section views as seen from lines 3—3, 4—4 and 5—5 respectively in FIG. 2;

FIG. 6 is an exterior view of a hammer body component used in the device of FIG. 1;

FIG. 7 is a side view of eccentric weights used in the vibratory hammer of the invention; and FIG. 8 is a graph illustrating the relationship of frequency ratio and phase angle.

Referring now to FIGS. 1 and 2, numeral 1 identifies a vibratory hammer having a support frame consisting of a pair of side plates 3, which are maintained in parallel position by means of tubular space bars 5, welded to the plates, as well as a tool holder element 7, similarly welded thereto. A hammer body assemblage 9 (FIG. 6) is suspended between the side plates 3 by resilient means consisting of four rubber mounts 11 affixed to the side plates and the hammer body assemblage by means of bolts 13 and 15. As will be apparent, the mounts serve as the sole guiding and damping means for the assemblage when the latter is vibrated during tool operation.

The hammer body assemblage 9 includes an eccentric weight chamber 17 enclosing a pair of eccentric weights

19 and 21, mounted upon shafts 23 supported in roller bearings 25 positioned in end caps 27, the latter being secured by bolt means 29 to side members 31 of the eccentric weight chamber 17 by bolts 32. Projecting from the top surface of the eccentric weight chamber 17 and affixed thereto, is an upper arm member 33 adapted to be affixed to the rubber mounts 11 by the bolts 15.

Projecting from the bottom surface of the eccentric weight chamber 17 and affixed thereto, is a lower arm member 35 adapted to be affixed to the rubber mounts 11 by the bolts 15. Brace members 37 are secured to the sides of the lower arm member 35 and the hammer body assemblage 9, to stabilize the arm member. An hydraulic motor 39, affixed to the end of shaft 23, is provided to rotate the eccentric weight 19. A pair of gears 41, mounted upon the shaft 23, is arranged to transmit rotary motion from the shaft which supports eccentric weight 19, to the shaft which supports eccentric weight 21, so that both weights are rotated at the same speed but in opposite directions. Hose means 43 supply pressurized hydraulic fluid to the motor 39 when desired, from a power source, not shown.

At the lower extremity of the arm member 35 is a striker plate 45 affixed thereto by means of pin 47. The striker plate is arranged to impact upon a conical tool 49 mounted in the tool holder element 7 as best seen in FIG. 2. Retaining means, including a key 51 projecting into a slot 53 formed in the tool 49, allow reciprocal movement of the tool. The tool slides in bushings 55 supported in a bushing housing 57, the latter positionally maintained against axial movement by a tool stop plate 59, affixed to the end of the tool holder by means of cap screws 61.

Support means for the vibratory hammer 1, are provided by a pivotally attached linkage assemblage 63, which may be operatively positioned by power machinery, e.g. tractor, not shown.

The design parameters of a vibratory hammer built in accordance with the invention disclosed herein, obviously will vary in accordance with the work impact output desired.

It is to be recognized that when a forcing frequency vibrates a mass at its natural frequency, the mass of the forcing frequency generator leads the vibrated mass by 90°. When the forcing frequency is much higher than the natural frequency, the forcing frequency mass could lead the vibrated mass by 180°. Accordingly, if the leading phase is 135°, the vertical component of centrifugal force of the vibrated mass, coupled with the stored energy of the rubber mounts, will produce maximum impacting on the tool 49.

The optimum phase angle of 135° ($\theta$) is determined by the following equation:

$$\tan\theta = \frac{2\zeta\frac{f}{fn}}{1-\frac{f^2}{fn^2}} \qquad \text{(Equation 1)}$$

where $\theta$=phase angle $\zeta$=damping factor f=forcing frequency CPM,RAD/SEC fn=natural frequency It can be seen from FIG. 8 that by plotting frequency ratio vs. $\theta$ with varying damping factors, that anything less than a critically damped system gives phase angles of approximately 180° at any frequency ratio greater than 1, hence, critical damping of the system is essential for optimum operative results. Critical damping by definition means no over oscillation when a mass is deflected from its static position and returned to the same static position. Critical damping is achieved by a preload, in the present vibratory hammer, by use of the rubber mounts 11.

It is essential, for optimum operation, that the stroke of the hammer be equal to the "in the air" displacement (S''), which is provided by the following equation:

$$S'' = \frac{2wr}{W} \qquad \text{(Equation 2)}$$

where w=unbalanced weight r=radius where unbalanced weight is located from the center of rotation W=total weight vibrated The rubber mounts 11 supporting the vibrated mass, i.e., hammer body assemblage 9, must be selected so that not only can the natural frequency be precisely determined, but the rubber mounts must be capable of storing sufficient energy to assist the eccentric weights 19 in the power stroke.

Suppose that it is desired to have a hammer of the invention which will deliver 200 ft.lbs/blow with 1200 blows/min. A primary value for the eccentric weights may be calculated as follows:

The energy delivered must be done in one complete revolution or two times the stroke X the centrifugal force, or $$C_f = \frac{wr\Omega^2}{12\,g} \qquad \text{(Equation 3)}$$

where:

$C_f$=Centrifugal force (lbs.)

wr=Unbalance (inch-lbs.)

Ω=Angular velocity (rad/sec or 125.6 rad/sec for 1200 rpm)

g=Acceleration due to gravity thus (Equation 3)×(Equation 2) gives the Ft.lb blow $$C_f \times \frac{S}{12} \text{ or } \frac{2wr\Omega^2}{12\,g} \times \frac{2wr}{12\,w} = 200 \text{ ft. lbs.}$$

However, only the root means square (rms) value of $C_f$ is utilized in vertical motion, which equals $$\frac{2.82\Omega^2 w^2 r^2}{144\,W} = 200 \text{ ft. lbs.} \qquad \text{(Equation 4)}$$

The total kinetic energy available in the eccentric weight is $$\frac{I\Omega^2}{2}$$

The rms is used leading to $$\frac{0.707\,I\Omega^2}{2} = 200 \text{ ft. lbs.} \qquad \text{(Equation 5)}$$

Where $$I = \text{Moment of Inertia} = \frac{wr^2}{144} \text{ lb ft. sec}^2 \qquad \text{(Equation 6)}$$

Substituting (Equation 6) in (Equation 5) gives $$\frac{0.707\,w^2\,wr^2}{288\,g} \qquad \text{(Equation 7)}$$

Equating (Equation 7) to (Equation 4) gives $$\frac{2.82\,w^2\,r^2\Omega^2}{144\,wg} = \frac{0.707\,wr^2\Omega^2}{288\,g} \qquad \text{(Equation 8)}$$

$$\therefore 8w = W$$

Hence, the total vibrated weight W must be eight times the eccentric weight w.

Substituting (Equation 8) in (Equation 4) yields $$\frac{2.82\,wr^2\Omega^2}{8 \times 144\,g} = 200 \text{ FT-LBS.}$$

thus $$wr^2 = 166.76 \text{ \#in}^2 \qquad \text{(Equation 9)}$$

The natural frequency of the system to provide a θ of 135° @ 1200 rpm is determined from Equation 1.

$$\tan\theta = \frac{2\zeta\frac{f}{fn}}{1 - \frac{f^2}{fn^2}}$$

wherein tan θ=−1 for 135°

ζ=damping factor=1 f=Operating Frequency=125.6 rad/sec. or 1200 rpm or 20 cps fn=Natural Frequency thus $$-1 = \frac{2\frac{f}{fn}}{1\left(\frac{f}{fn}\right)^2} \text{ or } \frac{f}{fn} = 2.4142$$

Hence, at 1200 rpm or 20 cps $$fn = \frac{20}{2.4142} = 8.28\ cps$$

Natural frequency is determined by static deflection as given by $$fn = 3.13\sqrt{\frac{1}{\Delta}} \qquad \text{(Equation 10)}$$

fn=Natural Frequency (in/sec) (cps) Δ=Static Deflection (inches) Hence, $$8.28 = 3.13\sqrt{\frac{1}{\Delta}}$$

$$\therefore \Delta = 0.1428 \text{ inches}$$

thus $$W/K = 0.1428$$

where

W = total vibrated weight (#)

K = Spring rate of suspension system (#/in.)

Using four mounts 11 with a combined spring rate of 3400 #/in., the total vibrated weight W is $$\frac{W}{3400} = 0.1428 \text{ or } W = 485.52 \#$$

Thus from Equation 8 $W = 8w$ $$w = \frac{485.52}{8} = 60.69 \# \text{ (eccentric weights 19 and 21)}$$

Equation 9 is used to determine the value r $$wr^2 = 166.76 \#\text{in}^2$$

$$60.69\, r^2 = 166.76$$

$$r = 1.6576 \text{ inches}$$

The required stroke can be determined from (Equation 2)

$$S = \frac{2\,wr}{W} = \frac{2 \times 60.69 \times 1.6576}{485.52} = 0.4144 \text{ inches}$$

In order to have the forces balanced when the hammer has come to rest at its maximum excursion of 0.4144" the total load due to extension of the suspension system must equal the centrigual force component @ the $\theta$ of 135°.

$$\text{Hence } C_f = \frac{wr\Omega^2}{12\,g} = \frac{100.59 \times 125.6^2}{386} = 4106 \#$$

the vertical component is 0.707 $C_f$ or $0.707 \times 4106 = 2902.94\#$

The preload applied to the suspension system must thus be 2902.94#. With a spring rate of 3400 #/in. the total deflection will be $$\frac{2902.94}{3400} = 0.8538''$$

However, the design stroke of 0.4144" must be subtracted from 0.8538" leaving 0.4394" which yields a preload of $0.4394 \times 3400 = 1493\#$ The preload of 1493# is three times the weight of the hammer (485.52#), and is of sufficient value to critically dampen the system.

By application of these formula, a vibratory hammer in accordance with the invention will have the following numeral values, if a work impact output of 200 ft.-lbs. at 1200 rpm is to be achieved:

| | | |
|---|---|---|
| Stroke | 0.4144 | inches |
| Weight of hammer body assemblage (9) | 485.52 | lbs. |
| w = | 60.69 | lbs. |
| r = | 1.6576 | inches |
| wr = | 100.59 | in. lbs. |
| $wr^2$ = | 166.76 | |
| K = | 3400 | #/in. |

The importance of utilizing a phase angle of 135° can be seen from comparison of hammer efficiencies when other phase angles are used.

For example, a computerized evaluation of a hammer operating at 1200 rpm with a phase angle of 141°, and a spring rate of 1850 #/in, required a hammer weight of 350 lbs. with a work impact output of 118 ft. lbs.

Another computerized evaluation of a hammer operating at 1200 rpm with a phase angle of 141°, and a spring rate of 1728 #/in, required a hammer weight of 322 lbs. with a work impact output of 103 ft.lbs.

Other computerized evaluations could be made to show that an operative phase angle of 135° will provide optimum hammer operational efficiency.

While an embodiment of the invention has been illustrated and described in detail to enable any person skilled in the art, to which it pertains, to make and use the same, it is expressly understood that the invention is not limited thereto. Various changes in form, design, or arrangement may be made in its parts without departing from the spirit and scope of the invention, it is my intention, therefore, to claim the invention, not only as shown and described, but also in all such forms and modifications thereof as might be reasonably construed to be within the spirit of the invention and the scope of the appended claims.

What is claimed is:

1. A vibratory impact hammer including a support frame, a hammer body assemblage suspended within the support frame by resilient means, having a selected suspension system spring rate, arranged to provide guiding and damping action in either direction of axial movement of the hammer body assemblage, said hammer body having a given stroke, wherein the stroke of the hammer body assemblage is equal to 2 wr/W, wherein w = unbalanced weight, r = radius where unbalance is located from the center of rotation and W = total weight vibrated, said resilient means being the sole means engaging the hammer body assemblage so that extraneous frictional forces are avoided, vibration drive means, including a pair of oppositely rotating eccentric weights, arranged to develop a forcing frequency to vibrate the hammer body assemblage in an axial direction, said forcing frequency, responsive to the relationship between hammer weight, eccentric weight, and spring rate of the suspension system so selected that the eccentric weights lead (set to lead the vibrated frequency of) the hammer body assemblage by 135°, and a tool reciprocably mounted in the support frame and positioned to receive impact blows of the hammer body assemblage when reciprocated by the vibration drive means.

2. A vibratory impact hammer according to claim 1, wherein said resilient means are rubber mounts.

3. A vibratory impact hammer according to claim 2, wherein said rubber mounts are arranged in pairs, one above the hammer body assemblage, the other below the hammer body assemblage.

4. A vibratory impact hammer according to claim 1, wherein said vibratory drive means includes a driving eccentric weight and a driven eccentric weight, and a motor means arranged to rotate the weights in synchronism.

5. A vibratory impact hammer according to claim 4, wherein said eccentric weights are inter-connected by a gear means.

6. A vibratory impact hammer according to claim 1, wherein a tool holder is provided for the tool, which tool holder includes means for removal of the tool from the hammer.

7. A vibratory impact hammer according to claim 1, wherein the stroke of the hammer body assemblage, is equal to the in the air displacement of the hammer body assemblage.

8. A vibratory impact hammer according to claim 8, wherein a hammer with a work impact output of 200 ft.-lbs at 1200 rpm, would have a stroke of 0.4144 inches, and a design parameters as follows:

W=485.52 lbs.
w=60.69 lbs.
r=1.6576 inches
wr=106.59 in.-lbs.
wr=166.76 lbs. in.
K spring rate=3400 #/in.

* * * * *